United States Patent [19]

Jacobson

[11] Patent Number: 4,587,729

[45] **Date of Patent: * May 13, 1986**

[54] SAFETY RAZOR

[75] Inventor: Chester F. Jacobson, Southboro, Mass.

[73] Assignee: The Gillette Company, Boston, Mass.

[ * ] Notice: The portion of the term of this patent subsequent to Dec. 18, 2001 has been disclaimed.

[21] Appl. No.: 661,086

[22] Filed: Oct. 15, 1984

Related U.S. Application Data

[63] Continuation-in-part of Ser. No. 419,186, Sep. 17, 1982, Pat. No. 4,488,357.

[51] Int. Cl.[4] ..... B26B 21/44

[52] U.S. Cl. ..... 30/41; 30/87

[58] Field of Search ..... 30/34 R, 41, 90, 87; 83/14

[56] References Cited

U.S. PATENT DOCUMENTS

| | | | |
|---|---|---|---|
| 2,292,418 | 8/1942 | Wetherbee | 30/41 |
| 3,768,161 | 10/1973 | Miller | 30/41 |
| 3,935,639 | 2/1976 | Terry et al. | 30/47 |
| 4,083,104 | 4/1978 | Nissen et al. | 30/47 |
| 4,170,821 | 10/1979 | Booth | 30/41 |
| 4,198,746 | 4/1980 | Trotta | 30/47 |
| 4,270,268 | 6/1981 | Jacobson | 30/47 |
| 4,291,463 | 9/1981 | Williams | 30/346.53 |
| 4,335,508 | 6/1982 | Francis et al. | 30/47 |
| 4,381,293 | 4/1983 | Michel | 424/14 |
| 4,488,357 | 12/1984 | Jacobson | 30/57 |

FOREIGN PATENT DOCUMENTS 2024082 1/1980 United Kingdom .

*Primary Examiner*—Jimmy C. Peters

*Attorney, Agent, or Firm*—Scott R. Foster

[57] ABSTRACT

A safety razor including a blade assembly and a handle assembly, the blade assembly including a blade having a cutting edge disposed between skin engaging elements adapted in operation to engage a surface being shaved ahead and behind, respectively, of the cutting edge, the blade being movable relative to the elements in response to forces encountered during a shaving operation, the blade assembly being pivotally mounted on the handle assembly whereby the blade assembly, as a whole, is pivotally movable on the handle assembly in response to forces encountered during the shaving operation, one of the skin engaging elements being provided with a water leachable shaving aid.

3 Claims, 11 Drawing Figures

SAFETY RAZOR

CROSS-REFERENCE TO RELATED APPLICATION

This is a continuation-in-part of application Ser. No. 419,186, filed Sept. 17, 1982 now U.S. Pat. No. 4,488,357 issued Dec. 12, 1984, in the name of Chester F. Jacobson.

BACKGROUND OF THE INVENTION

1. Field of the Invention

The invention relates to wet shaving implements and is directed more particularly to a safety razor in which a blade assembly, as a whole, is movable on a handle assembly during a shaving operation, and individual components of the blade assembly are independently movable during the shaving operation.

2. Description of the Prior Art

It is known in the art to provide a razor blade assembly which may be connected to, and used in conjunction with, a razor handle to facilitate shaving operations. U.S. Pat. No. 3,724,070, issued Apr. 3, 1973, in the name of Francis W. Dorion, Jr. shows a blade assembly in which blade means are held between blade assembly surfaces adapted to engage the surface being shaved in front of and behind, respectively, cutting edge portions of the blade means. Such surfaces are generally referred to as "guard" and "cap".

In due course, it became known that the shaving efficiency of such a safety razor assembly could be improved if the blade assembly were adapted to pivot on the razor handle during a shaving operation, permitting the blade assembly to more closely follow the contours of a surface being shaved. U.S. Pat. No. 3,935,639, issued Feb. 3, 1976, in the name of John C. Terry, et al, and U.S. Pat. No. 3,938,247, issued Feb. 17, 1976, in the name of Nelson C. Carbonell, et al, are illustrative of razor handles adapted to accept the blade assembly of the '070 patent in such a manner as to permit pivotal movement of the blade assembly during a shaving operation. U.S. Pat. No. 3,950,849, issued Apr. 20, 1976, in the name of Roger L. Perry, illustrates a modified blade assembly adapted for pivotal movement. U.S. Pat. No. 4,026,016, issued May 31, 1977, in the name of Warren I. Nissen, and U.S. Pat. No. 4,083,104, issued Apr. 11, 1978, in the name of Warren I. Nissen, illustrate, respectively, a blade assembly and razor handle comprising a shaving system in which the blade assembly pivots on the handle during shaving. The shaving system shown in '016 and '104 patents has become well-known worldwide.

Another means by which increased shaving efficiency may be obtained is that of retaining the blade assembly, as a whole, stationary but permitting movement of individual components thereof in response to forces encountered during shaving. In U.S. Pat. No. 4,168,571, issued Sept. 25, 1979, in the name of John F. Francis, there is shown a blade assembly in which the guard, cap and blade means are each movable independently of each other in dynamic fashion. U.S. Pat. No. 4,270,268, issued June 2, 1981, in the name of Chester F. Jacobson, shows a blade assembly in which the guard and blade means are independently movable.

SUMMARY OF THE INVENTION

An object of the present invention is to provide a safety razor including a blade assembly and a handle assembly, which provides the benefits of the '016 and '104-type system, as well as the benefits of the '571 and/or '268-type system.

A further object of the invention is to provide a safety razor as above described with a self-lubrication facility.

With the above and other objects in view, as will hereinafter appear, a feature of the present invention is the provision of a safety razor including a blade assembly and a handle assembly, the blade assembly including blade means having cutting edge means disposed between skin engaging elements adapted in operation to engage a surface being shaved ahead and behind, respectively, of the cutting edge means, the blade means being movable relative to the elements in response to forces encountered during a shaving operation, the blade assembly having pivot mounting means thereon, and the handle assembly having complemental pivot mounting means thereon, whereby the blade assembly, as a whole, is pivotally movable on the handle assembly in response to forces encountered during the shaving operation, one of the skin-engaging elements being provided with a water leachable shaving aid.

The above and other features of the invention, including various novel details of construction and combinations of parts will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
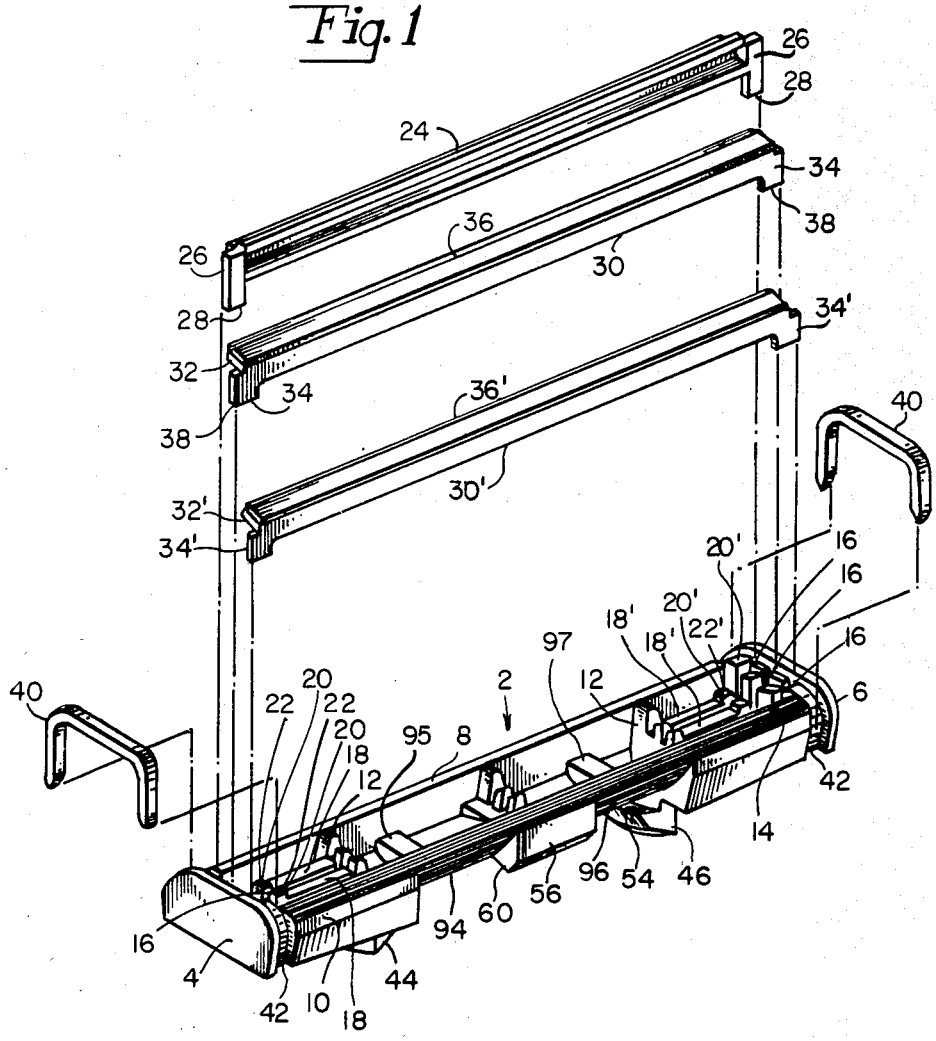
FIG. 1 is an exploded perspective view of one form of blade assembly illustrative of an embodiment of the invention.
Figure 2:
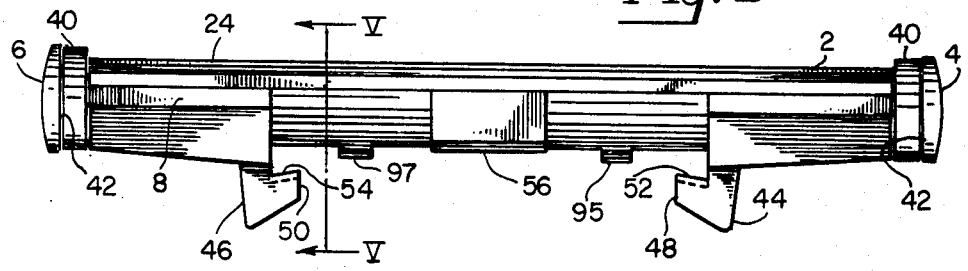
FIG. 2 is a front elevational view thereof.
Figure 3:
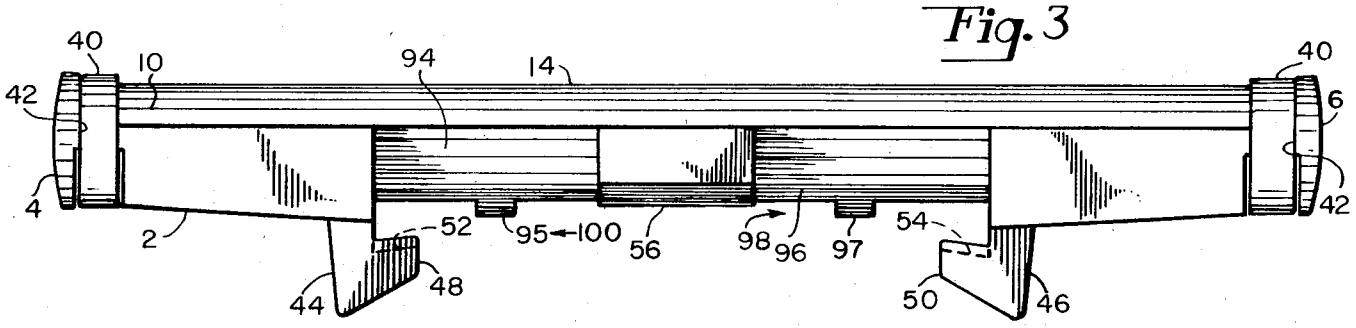
FIG. 3 is a back elevational view thereof.

Referring to the drawings, it will be seen that the illustrative razor blade assembly includes a body member 2 having first and second end portions 4, 6 interconnected by front and back wall portions 8, 10. Frame portions 12 extend width-wise of the body member, interconnecting the front and back walls 8, 10.

The back wall portion 10 of the body member 2 has an upper portion 14 which engages skin being shaved behind the cutting means of the assembly, thereby fulfilling the functions and occupying the position of the "cap" portion of conventional razor blade assemblies. Such portion 14 shall, for that reason, be referred to hereinafter as the "cap portion".

Each of the end portions 4, 6 is provided with opposed slots 16 disposed transversely to the frame portions 12. One of the frame members 12 near the first end portion 4 is provided with spring fingers 18 extending therefrom generally parallel to the front and back walls 8, 10. Each of the fingers 18 is provided with an upturned end portion 20 having an upper surface 22. In like manner, another of the frame members 12 near the second end portion 6 is provided with spring fingers 18' of similar configuration, with upturned end portions 20' having upper surfaces 22'. The fingers 18, 18' extend in opposite directions, the fingers 18 extending toward the first end portion 4 of the body member 2 and the fingers 18' extending toward the second end portion 6 of the body member. The fingers 18 and the fingers 18' are aligned with each other and with the slots 16.

The assembly includes a guard portion 24 having a slide member 26 at each end thereof. The slide members 26 are received in a pair of opposed slots 16 nearest the front wall portion 8. The bottom of the guard portion rests upon the surfaces 22, 22' of a pair of the spring fingers 18, 18'. The lower edges 28 of the slide members 26 rest above the bottoms of their slots 16, allowing the guard portion 24 to be moved further into the slots, against the bias of the spring fingers therebeneath. The spring fingers supporting the guard portion comprise a set of spring fingers, the object of which is to resiliently support the guard portion. In shaving operation, the guard portion travels over the surface being shaved ahead of the cutting means.

The assembly further includes a blade means comprising a blade support including a base portion 30, a platform portion 32 extending from the base portion, slide portions 34 at each end of the base portion, and a blade 36 fixed to the platform portion. The slide portions 34 are received in a pair of the opposed slots 16, with a bottom edge of the base portion 30 resting upon the surfaces 22 of a second pair of the spring fingers 18, 18'. Lower edges 38 of the slide portions 34 are spaced from the bottoms of their slots to permit movement of the blade support base portion further into the slots 16 against the bias of the spring fingers 18, 18' on which the blade support base portion rests. The spring fingers supporting the blade support comprise another set of spring fingers, the object of which is to resiliently support the blade means thereon.

In the embodiment illustrated, the blade means include a second blade support including a base portion 30', a platform portion 32', slide portions 34' and a blade 36', all anchored similarly to the above-described first blade support. The slide portions 34' are received in a third pair of the opposed slots 16 nearest the cap portion 14 with the base portion 30' resting upon spring finger surfaces. The spring fingers supporting the second blade support comprise still another set of spring fingers, which resiliently support the second blade. In a shaving operation, the second blade travels over the surface being shaved behind the first blade.

The guard portion 24, first and second blades 36, 36' are clamped in place by spring clamps 40, which are received in slots 42 in the end portions 4, 6. The clamps 40 engage the guard portion 24 and the blades 36, 36', forcing them into the slots 16 to a point where a slight stress is placed on the spring fingers 18, 18'.

Figure 4:
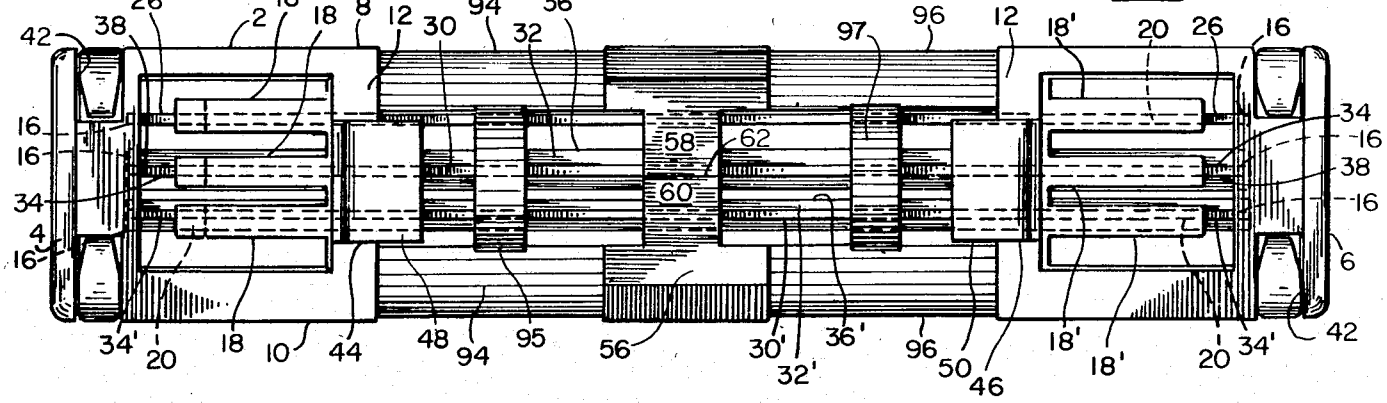
FIG. 4 is a bottom plan view thereof.
Figure 5:
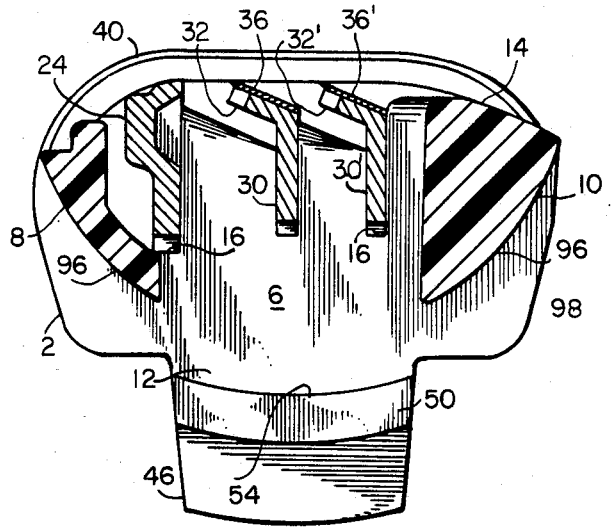
FIG. 5 is a sectional view, taken along line V—V of FIG. 2.

On the underside of the body member 2 and the frame portions 12, are disposed two extensions 44, 46 having at their free ends, respectively, inwardly extending opposed rails 48, 50, each rail having respective arcuate upper surfaces 52, 54. As will be further discussed below, the extensions comprise a pivot mounting means by which the blade assembly may be removably and pivotally attached to a razor handle. Referring to FIGS. 4 and 5, it will be seen that the blade assembly body member underside is additionally provided with cam means 56 comprising surfaces 58 and 60 joining at an apex 62, the surfaces 58, 60 defining therebetween an obtuse angle. As will be further described below, the cam means 56 is adapted to receive a cam follower operative to urge the blade assembly to a given position.

Figure 6:
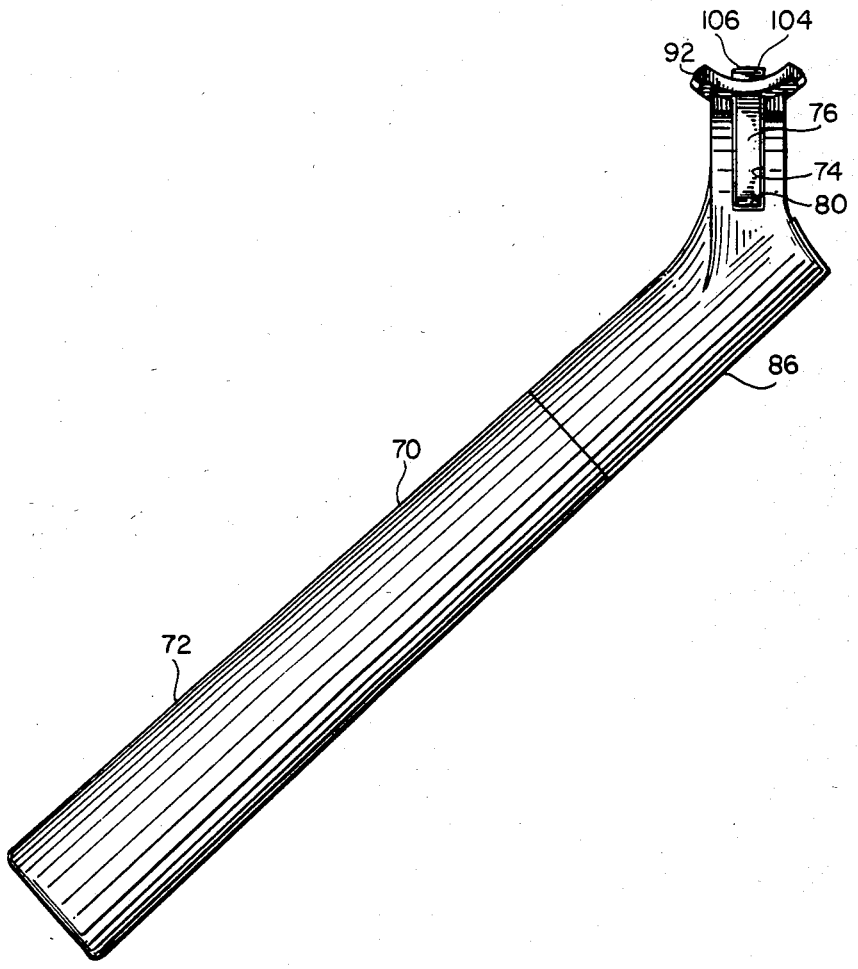
FIG. 6 is a side elevational view of one form of handle assembly illustrative of an embodiment of the invention.
Figure 7:
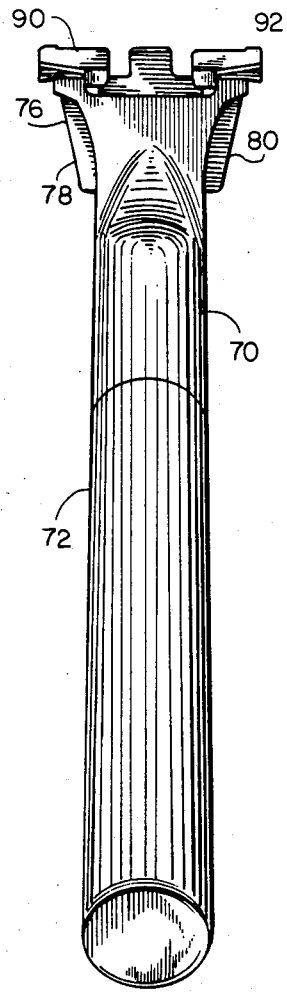
FIG. 7 is a front elevational view thereof.
Figure 8:
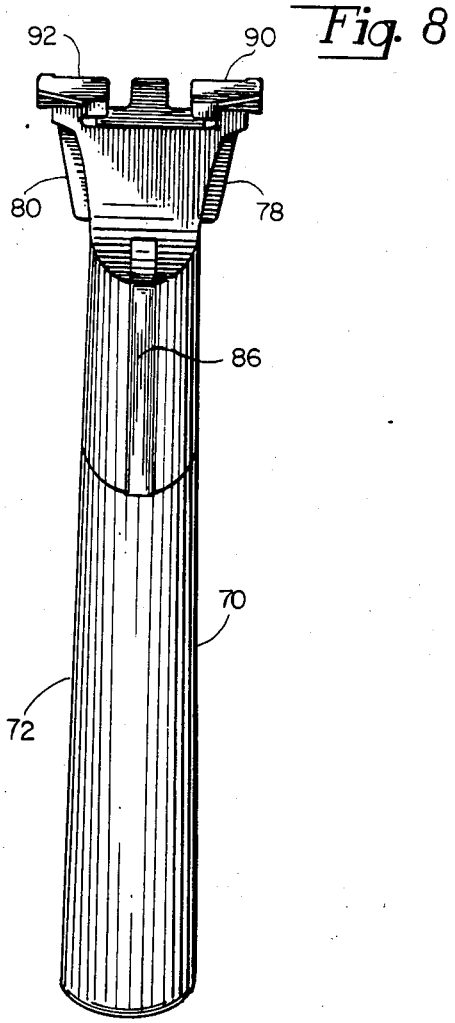
FIG. 8 is a back elevational view thereof.

Referring to FIGS. 6–8, it will be seen that the invention includes a razor handle assembly 70 having a grip portion 72. One end of the grip portion 72 is provided with a recess 74 in which is disposed a molded plastic head portion 76 comprising two arms 78, 80 joined by a bridge portion 82. The grip portion 72 is further provided with a slot 84 in which is disposed a key member 86. The key member 86 includes a projection 88 which is disposed against the bridge portion 82 in a manner securely locking the head portion 76 to the grip portion 72. Each of the arms 78, 80 has disposed on its free end, respectively, a shell bearing 90, 92.

Referring again to FIG. 5, it will be seen that the blade assembly rails 48, 50, in conjunction with undersurfaces 94, 96 of the body member 2, and arcuate struts 95, 97, define arcuate slots 98, 100 adapted to receive the shell bearings 90, 92 respectively. Thus, the shell bearings 90, 92 comprise a shell bearing means which constitutes a pivot mounting means adapted to cooperate with the above described blade assembly pivot mounting means to facilitate pivotal connection of the blade assembly to the razor handle assembly (FIGS. 9 and 10).

In the handle recess 74, there is disposed a coil spring 102 and a plunger member 104, the spring biasing the plunger in the direction of the free end 106 of the plunger member 104. When the blade assembly is connected to the handle assembly, the free end 106 of the plunger member 104 is urged by the spring 102 into engagement with the blade assembly cam means 56. During pivoting operation of the blade assembly, the plunger end 106 bears against the cam surfaces 58, 60, to urge the blade assembly to a given position, the position in which the plunger end 106 rests at the apex 62 of the cam means 56.

Figure 9:
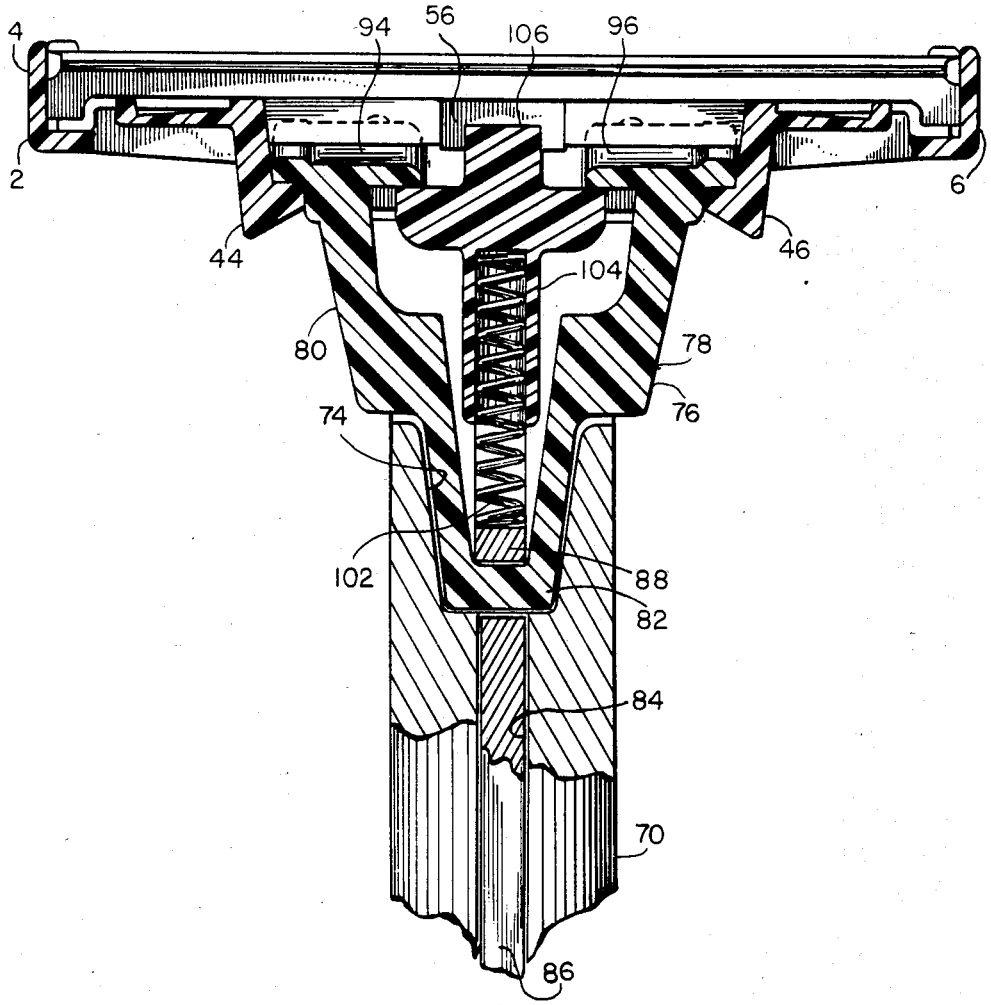
FIG. 9 is a sectional view of the blade assembly attached to the handle assembly, taken along the lengthwise centerline of the blade assembly.
Figure 10:
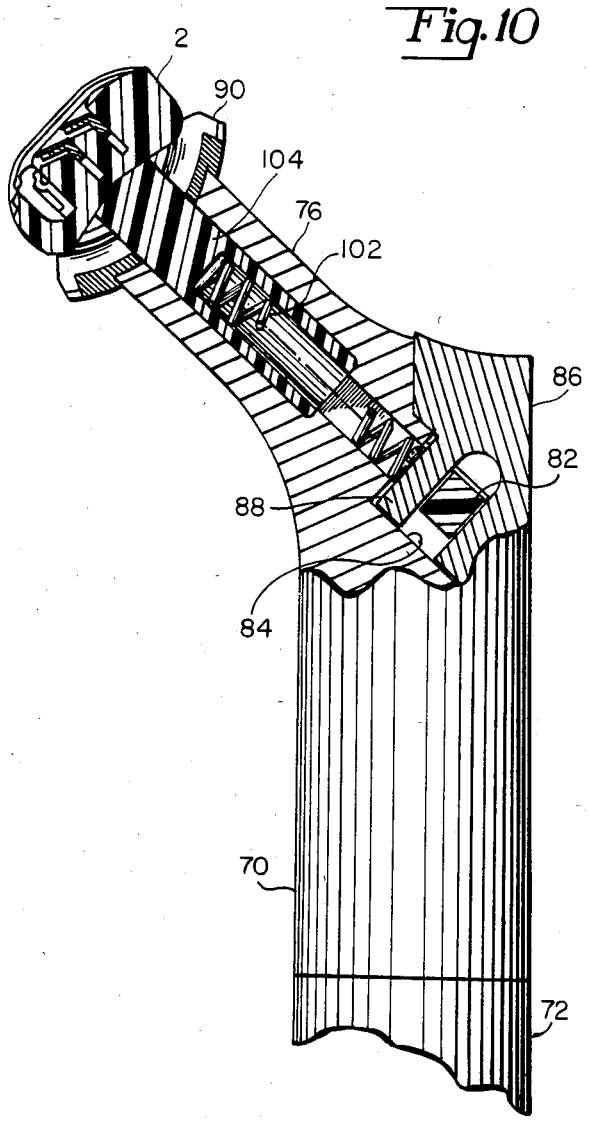
FIG. 10 is a sectional view of the blade assembly attached to the handle assembly, taken along the widthwise centerline of the blade assembly.

Referring particularly to FIGS. 8 and 9, it will be seen that the arms 78, 80 extend beyond the sides of the handle and are accessible to an operator. To connect the blade assembly to the handle assembly, the operator presses the arms 78, 80 inwardly, toward each other, moving the shell bearings 90, 92 toward each other.

The shell bearings 90, 92 are then pressed against the blade assembly underside arcuate struts 95, 97, and the arms 78, 80 released. Upon release of the arms 78, 80, the arms spring outwardly in opposite directions away from each other, the shell bearings 90, 92 entering the arcuate slots 98, 100. The spring biased plunger member 104 engages the cam means 56, seeking the apex 62 of the cam means and thereby urging the blade assembly to a "neutral" position.

During a shaving operation, the guard portion 24 and the blades 36, 36' move independently of each other against the bias of the spring fingers 18, 18'. Simultaneously, the blade assembly, as a whole, pivots on the handle, following the contours of the surface being shaved.

When it is desired to discard a used blade assembly, the operator need only compress the arms 78, 80, removing the shell bearings 90, 92 from the arcuate slots 98, 100 and releasing the blade assembly.

Figure 11:
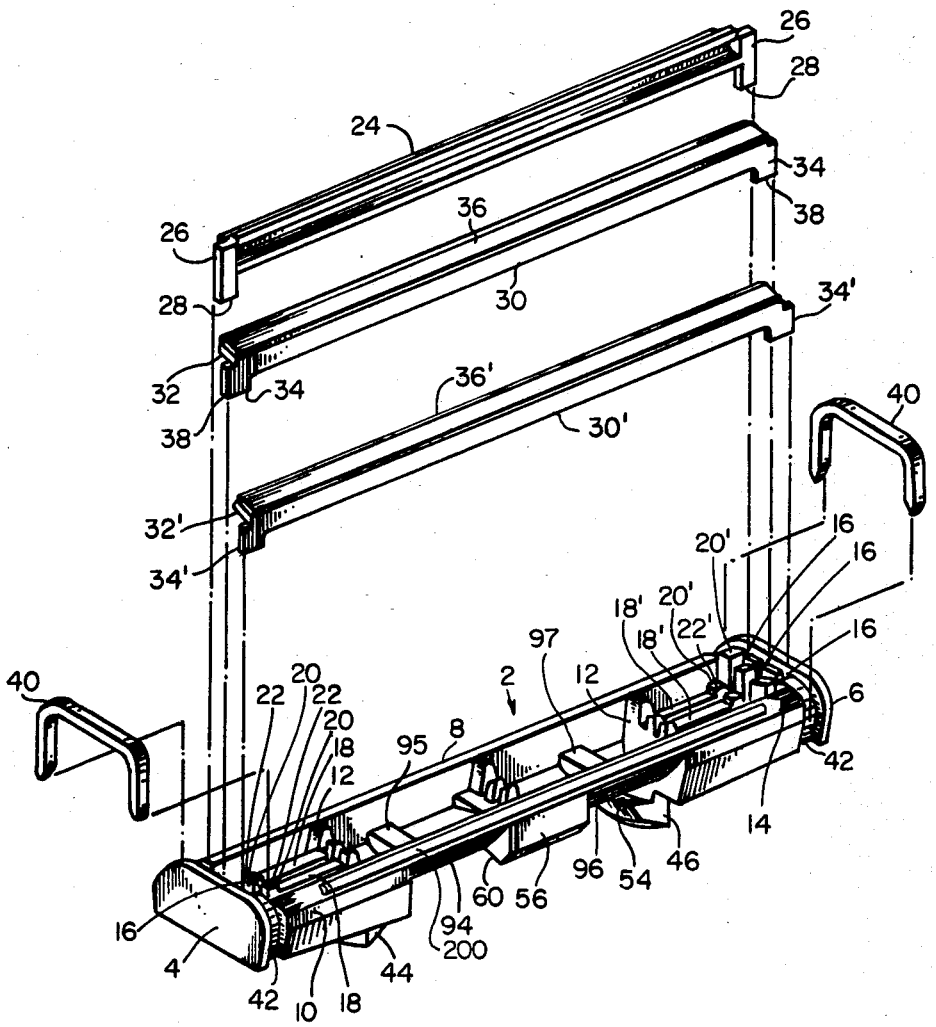
FIG. 11 is a perspective view of a portion of the blade assembly of FIG. 1, shown with an illustrative shaving aid strip fixed thereto.

In FIG. 11, there is disclosed an embodiment in which one of the skin-engaging elements 14 is provided with a shaving aid 200 of the general type disclosed in U.S. Pat. Nos. 2,292,418, issued Aug. 11, 1942 to H. E. Wetherbee; and 4,170,821 issued Oct. 16, 1979 to Anthony R. Booth; as well as U. K. Patent No. 2,024,082; application published Jan. 9, 1980; patent published May 6, 1982 in the name of Harry Pentney, et al.

The shaving aid 200 is preferably in the form of a body of material fixed to a skin-engaging surface, such as the cap portion 14 shown in FIG. 11 for illustrative purposes.

The shaving aid material preferably comprises a molded, extruded, or otherwise formed mixture of a hydrophobic material and a water leachable hydrophilic polymeric material such that, during a shaving operation, water present on the area to be shaved leaches out the hydrophilic material which may serve as a lubricant. Alternatively, one or more of the skin-engaging elements 14, 24 may be formed of the shaving aid mixture.

In operation, wetting the surface to be shaved with water prior to shaving causes, during shaving, leaching out of a portion of the water-soluble material which serves to lubricate the shaving surface. Thus, comfortable and effective shaving can be obtained by simply wetting the shaving area prior to shaving.

It is to be understood that the present invention is by no means limited to the particular construction herein disclosed and/or shown in the drawings, but also comprises any modifications or equivalents within the scope of the disclosure. For example, it is preferable under certain conditions that the guard portion be immovable. An alternative embodiment includes a guard portion fixed immovably to the blade assembly body member, but in all other respects structured and operated in accordance with the above description. As a further example, the blade means may include a single blade, rather than the two blade arrangement described, the single blade being used in conjunction with either a movable or stationary guard portion.

Having thus described my invention what I claim as new and desire to secure by Letters Patent of the United States is:

1. A safety razor including a blade assembly and a handle assembly, said blade assembly comprising a body portion of molded plastic, first and second blades mounted on said body portion between skin engaging elements adapted in operation to engage a surface being shaved ahead and behind, respectively, of said blades, said blades each being independently movable relative to said elements in response to forces encountered during a shaving operation, one of said skin-engaging elements comprising a guard portion independently movable during said shaving operation, one of said skin-engaging elements having thereon a shaving aid formed of a hydrophobic material and a water leachable hydrophilic polymeric material, spring finger biasing means integral with said body portion and exercising a bias against said guard portion and said first and second blades, said blade assembly having pivot mounting means thereon and an underside cam portion, said handle assembly comprising a grip portion, a head portion at one end of said grip portion, complemental pivot mounting means on said head portion comprising shell bearing means adapted to receive said blade assembly pivot mounting means, whereby said blade assembly, as a whole, is pivotally movable on said handle assembly in response to forces reciprocally movable in said head portion to engage said underside cam portion of said blade assembly to exercise a bias on said blade assembly and thereby urge said blade assembly to a given position on said shell bearing means.

2. A safety razor in accordance with claim 1 in which said shaving aid comprises a member fixed to said skin-engaging element.

3. A safety razor in accordance with claim 2 in which the skin-engaging element to which said shaving aid member is fixed comprises a cap portion of said blade assembly.

* * * * *

UNITED STATES PATENT AND TRADEMARK OFFICE

CERTIFICATE OF CORRECTION

PATENT NO. : 4,587,729

DATED : May 13, 1986

INVENTOR(S) : Chester F. Jacobson

It is certified that error appears in the above-identified patent and that said Letters Patent is hereby corrected as shown below:

Column 6, line 37 : after "forces" insert

-- encountered during said shaving operation, and a spring-biased plunger --

Signed and Sealed this

Nineteenth Day of July, 1988

*Attest:*

DONALD J. QUIGG

*Attesting Officer*

*Commissioner of Patents and Trademarks*